US010851986B2

(12) United States Patent
Zhang et al.

(10) Patent No.: US 10,851,986 B2
(45) Date of Patent: Dec. 1, 2020

(54) WATERPROOF LAMP

(71) Applicants: Self Electronics Co., Ltd., Zhejiang (CN); Wanjiong Lin, Zhejiang (CN); Self electronics USA Corporation, Norcross, GA (US)

(72) Inventors: Chengke Zhang, Zhejiang (CN); Zhaoyong Zheng, Zhejiang (CN)

(73) Assignees: Wanjiong Lin, Ningbo (CN); Self Electronics Co., Ltd., Ningbo (CN); Self Electronics USA Corp., Norcross, GA (US)

( * ) Notice: Subject to any disclaimer, the term of this patent is extended or adjusted under 35 U.S.C. 154(b) by 47 days.

(21) Appl. No.: 16/422,480

(22) Filed: May 24, 2019

(65) Prior Publication Data

US 2019/0360684 A1 Nov. 28, 2019

(30) Foreign Application Priority Data

May 24, 2018 (CN) ..... 2018 1 0507109

(51) Int. Cl.

| | |
|---|---|
| ***F21V 31/00*** | (2006.01) |
| ***F21V 15/015*** | (2006.01) |
| ***F21V 17/12*** | (2006.01) |
| ***H01R 13/52*** | (2006.01) |
| ***F21W 131/00*** | (2006.01) |

(52) U.S. Cl.

CPC ..... *F21V 31/005* (2013.01); *F21V 15/015* (2013.01); *F21V 17/12* (2013.01); *H01R 13/521* (2013.01); *F21W 2131/00* (2013.01)

(58) Field of Classification Search

CPC ..... F21V 31/005; F21V 15/015; F21V 17/12; F21V 23/002; F21V 31/00; H01R 13/521; F21W 2131/00; F21S 8/00; F21S 4/28

See application file for complete search history.

(56) References Cited

U.S. PATENT DOCUMENTS

| | | | | |
|---|---|---|---|---|
| 9,163,808 | B1 * | 10/2015 | Lehman | F21V 15/01 |
| 2011/0149576 | A1 * | 6/2011 | Hsu | F21V 29/004 362/294 |
| 2011/0266282 | A1 * | 11/2011 | Chu | H05K 5/06 220/361 |
| 2012/0162982 | A1 * | 6/2012 | Wang | F21V 15/013 362/235 |
| 2012/0229025 | A1 * | 9/2012 | Edwards, Jr. | H05B 33/0803 315/35 |

(Continued)

*Primary Examiner* — Erin Kryukova

(74) *Attorney, Agent, or Firm* — Wang Law Firm, Inc.

(57) ABSTRACT

A waterproof lamp includes a housing having an inner cavity for receiving a lamp body, and at least one end forming a wiring opening for drawing out wiring; a wiring end cover is sealed on the wiring opening and can be threaded out; a first sealing member is formed between the wiring end cover and the interior surface of the housing and engages with the wiring end cover for the wire to pass through; the wiring end cover includes a fixed cover and a movable cover, the movable cover is detachably coupled to the outer side of the fixed cover; and a second sealing member is disposed between the movable cover and the fixed cover. The first sealing member of the waterproof lamp is filled with liquid and can be solidified to form a waterproof rubber layer sealed between the first sealing member and the inner wall of the housing.

9 Claims, 10 Drawing Sheets

(56) References Cited

U.S. PATENT DOCUMENTS

| | | | | |
|---|---|---|---|---|
| 2012/0300460 | A1* | 11/2012 | Liu | F21V 19/02<br>362/249.02 |
| 2015/0377475 | A1* | 12/2015 | Ji | F21V 31/04<br>362/374 |
| 2016/0356460 | A1* | 12/2016 | Lu | F21V 17/12 |
| 2019/0178483 | A1* | 6/2019 | Huang | F21V 31/005 |

* cited by examiner

WATERPROOF LAMP

RELATED APPLICATION

This application claims priority to Chinese patent application No. CN 201810507109.2, filed on May 24, 2018.

FIELD OF THE TECHNOLOGY

The present invention relates to lighting technology, with particular emphasis on a waterproof lamp.

BACKGROUND OF THE INVENTION

LED lamps are more and more common in daily life, and some environments are more humid, such as shower rooms, so they have high requirements for waterproof performance of lamps. Most of the existing lamps have only been studied on the side waterproofing of the lamps and the lamp holders, and there is less attention to the waterproofing at both ends of the lamps, as well as for lamps that can be wired by opening both ends.

For example, the Chinese invention patent "an LED lamp" of the application number CN201610130077.X, the two ends of the lamp of the patent are sealed by a terminal cover, the terminal cover includes an intermediate end cover and an outer end cover detachably connected with the intermediate end cover. It can complete the line installation and maintenance work by removing the outer end cover, but between the outer end cover and the intermediate end cover and between the intermediate end cover and the casing are only sealed by the sealing ring, and the conventional sealed waterproof structure will inevitably leave a gap, so that the sealing effect is not good and cannot be effectively waterproofed.

BRIEF SUMMARY OF THE INVENTION

The technical problem to be solved by the present invention is to provide a waterproof lamp which is easy to wire and has a good sealing effect in view of the current state of the art.

The technical scheme adopted by the invention to solve the above technical problems is as follows: a waterproof lamp comprising: a housing having a cavity for accommodating the main body of the lamp, and forming a wiring opening for leading out wire at least at one end of the housing; a wiring end cover sealed on the wiring opening for allowing the wire to pass through; the waterproof lamp further comprising a first sealing member formed between the wiring end cover and the inner wall surface of the housing and matched with the wiring end cover for the wire to pass through; the first sealing member is provided with a sealant groove for injecting liquid sol on a surface in contact with the inner wall surface of the housing; the wiring end cover includes a fixed end cover and a movable cover, and the movable cover is detachably connected to outside of the fixed end cover; a second sealing member is disposed between the movable cover and the fixed end cover.

advantageously, the first sealing member has an annular outer sealing portion and an inserting portion protruding from the outer sealing portion to one side, the outer sealing portion is clamped between the fixed end cover and an end wall surface of the wiring opening, and the inserting portion can be embedded into the inner cavity of the housing and in close contact with the inner wall surface of the housing, and the sealant groove is arranged on a surface in contact with the inner wall surface of the housing and the inserting portion. The first sealing member has a double sealing waterproof effect, wherein the outer sealing portion is clamped between the fixed end cover and the end wall surface of the wiring opening to realize the first waterproof seal, and the waterproof rubber layer formed by injecting the liquid sol into the sealant groove of the inserting portion is fully in contact with the inner wall surface of the housing to realize the second waterproof seal.

advantageously, the first sealing member has a through hole for wire going through; the fixed end cover is provided with a wire crossing opening for the wire outgoing through, the movable cover has an wire outlet opening corresponding to the wire crossing opening; the second sealing member is sealed on the periphery of the wire crossing opening.

advantageously, the fixed end cover is provided with a first injection hole for injection glue into the sealant groove, and at a corresponding position with the first injection hole the first sealing member is provided with a second injection hole, which is from the first injection hole through to the sealant groove.

advantageously, the wiring end cover comprises a fixing plate for fixedly connecting the first sealing member to the fixed end cover, and the fixing plate has a supporting portion that supports the inserting portion fitting to an inner wall surface of the housing. The first sealing member can be fixed on the fixed end cover by the fixing plate to form an integral member. In the process of installation, the integral member can be directly stuck in the wiring opening, instead of installing each part in turn, which simplifies the installation procedure. The supporting portion is provided to clamp the inserting portion between the supporting portion and the inner wall surface of the outer housing to prevent the bottom portion of the inserting portion from deforming or deflecting inwardly due to the lack of limiting action, resulting in poor waterproof sealing effect.

advantageously, the supporting portion has a deputy supporting portion, and a lower end surface of the inserting portion of the first sealing member is provided with a fitting groove for the deputy supporting portion to be stuck into. The deputy supporting portion is inserted into the fitting groove to further make the inserting portion tightly fit the inner wall of the housing, thereby reducing the deformation or deflection to the inside of the embedded part and improving the waterproof sealing effect.

advantageously, the fixed end cover and the movable cover are provided with waterproof ribs on the side opposite to the second sealing member, and the waterproof rib is embedded in the corresponding portion of the second sealing member to achieve sealing. The setting of the waterproof rib further improves the sealing effect of the periphery of the wire crossing opening on the fixed end cover.

advantageously, the fixed end cover and the housing are fixed by screws; the movable cover is connected to the fixed end cover by screws. The screw fixation between the fixed end cover and the housing can avoid the fixed end cover swaying or deflecting relative to housing, further improving the tightness between the first sealing member and the inner wall surface of the housing.

advantageously, the fixed end cover further has an annular limiting portion surrounding the outer periphery of the movable cover, and inner wall surface of the annular limiting portion and the movable cover are connected by rib groove. The rib and groove matching type between the inner wall surface of the annular limiting portion of the fixed end cover and the movable cover further improve the waterproof effect between the fixed end cover and the movable cover.

advantageously, the housing has two openings, one of which is wiring opening and the other opening is a sealing opening, and the sealing opening is covered with a sealing end cover, the sealing end cover is identical in structure to the wiring end cover, and the wire outlet opening of the movable cover of the sealing end cover is sealed with a waterproof plug. A waterproof plug is arranged in the wire outlet opening of the movable cover of the sealing end cover to realize the sealing of the sealing end. For sealing end cover and the wiring end cover only need to process a type of end cover structure, which reduces the processing cost. In addition, this kind of lamps can choose any opening used to elicit wiring, and the applicability is more extensive.

Advantages of the present invention compared with the prior art: the wiring structure of the lamp of the present invention includes a fixed end cover fixedly disposed at the wiring opening and a movable cover detachably fastened to the fixed end cover, in the wiring it is convenient to quickly open the movable cover for wiring or maintenance; a first sealing member is disposed between the fixed end cover and the inner wall surface of the housing. The first sealing member has a sealant groove and the sealant groove can be solidified to form a waterproof rubber layer sealed between the first sealing member and the inner wall of the housing after being injected into the liquid sol. Due to the fluidity of the liquid sol, it can penetrate into the gap between the first sealing member and the inner wall surface of the housing during injection, so it has a good waterproof effect and can be easily applied to places or devices with high humidity such as outdoor, bathroom or freezer.

BRIEF DESCRIPTION OF THE DRAWINGS the drawings described herein are intended to promote a further understanding of the present invention, as follows.

DETAILED DESCRIPTION OF THE INVENTION

Figure 1:
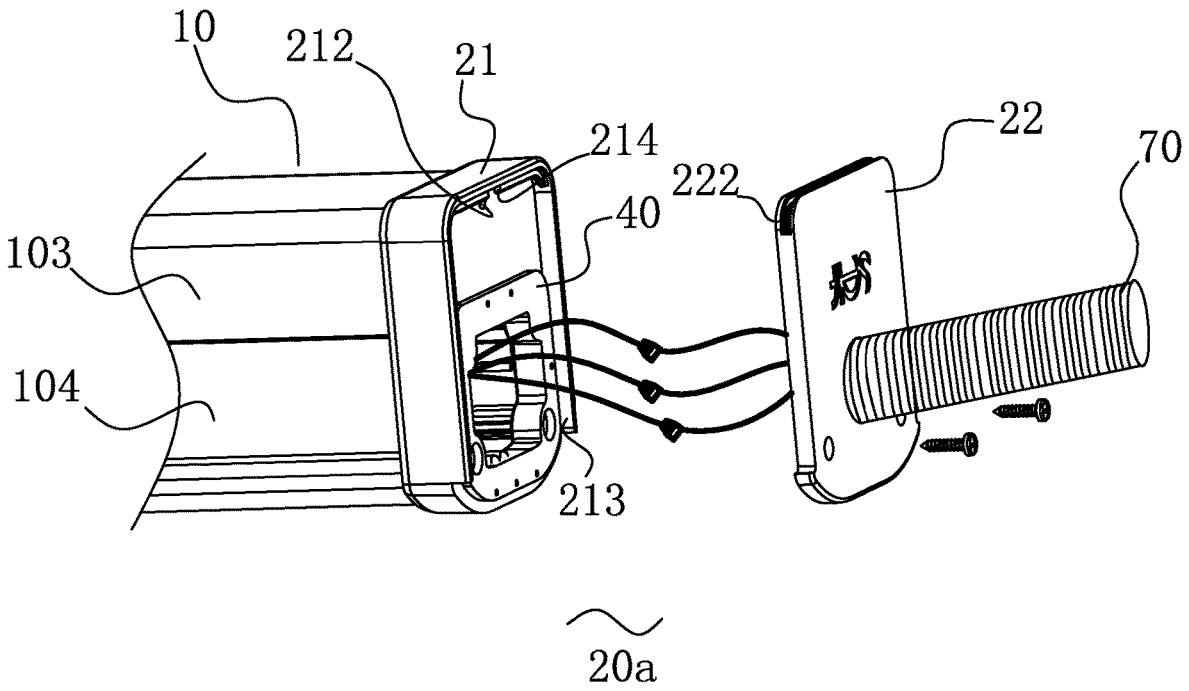
FIG. 1 is a schematic diagram of the three-dimensional structure of a waterproof lamp according to an embodiment of the present invention, wherein the movable cover is in an open state.

Embodiments of the invention are described in detail below, Examples of the embodiments are shown in the appended drawings in which consistently identical or similar labels represent identical or similar elements or elements having the same or similar function. The embodiments described below by reference to the drawings are exemplary and are only used for the interpretation of the invention and cannot be understood to be a limitation of the invention.

As shown in FIG. 1 to FIG. 6, the waterproof lamp comprises a housing 10, the housing 10 has a cavity for accommodating the main body of the lamp and two openings, wherein one opening is a wiring opening 101, and a wiring end cover 20*a* is sealed arranged on the wiring opening 101, and the wiring end cover 20*a* can be used for the wire used to connect external power supply to pass through, the other opening of the housing 10 is a sealing opening 102, and the sealing opening 102 is covered with a sealing end cover 20*b*. In this embodiment, the waterproof lamp further includes first sealing member 30 formed between the wiring end cover 20*a* and the inner wall surface of the housing 10 and matched with the wiring end cover 20*a* for the wire to pass through, the first sealing member 30 is provided with a sealant groove 31 for injecting liquid sol on the surface in contact with the inner wall surface of the housing 10. Specifically, the wiring end cover 20*a* includes fixed end cover 21 and movable cover 22, and the fixed end cover 21 is fixedly connected to the wiring opening 101 of the housing 10, and the movable cover 22 is detachably connected to the outside of the fixed end cover 21; A second sealing member 40 is arranged between the movable cover 22 and the fixed end cover 21. More specifically, the housing 10 comprises a lamp cover 103 and a lamp holder 104, which are buckled together and sealed by sealant at the buckled position. The wiring end cover 20*a* of the waterproof lamp only needs to open the movable cover 22 for wiring or maintenance when wiring, which is convenient and quick; on the other hand, the first sealing member 30 provided between the fixed end cover 21 and the inner wall surface of the housing 10 is provided with a sealant groove 31, which can be solidified after being injected with liquid sol to form a waterproof rubber layer sealed between the first sealing member 30 and the inner wall of housing 10. Due to the fluidity of the liquid sol, when injecting, it can penetrate into the gap between the first sealing member 30 and the inner wall surface of the housing 10, especially for the split housing 10 composed of the lamp cover 103 and the lamp holder 104. The waterproof rubber layer formed by the curing can seal the gap between the lamp cover 103 and the bottom housing, so that it has a good waterproof effect, and can be conveniently applied to a place or a device with a large humidity such as an outdoor, a bathroom or a freezer. Of course, it is conceivable for those skilled in the art that in order to achieve interconnection between adjacent lamp bodies, the two openings of the waterproof lamp may be both the wiring opening 101, one of which is used for wiring with an external power source. The other opening is used for wiring with adjacent lamp bodies for interconnection.

Figure 2:
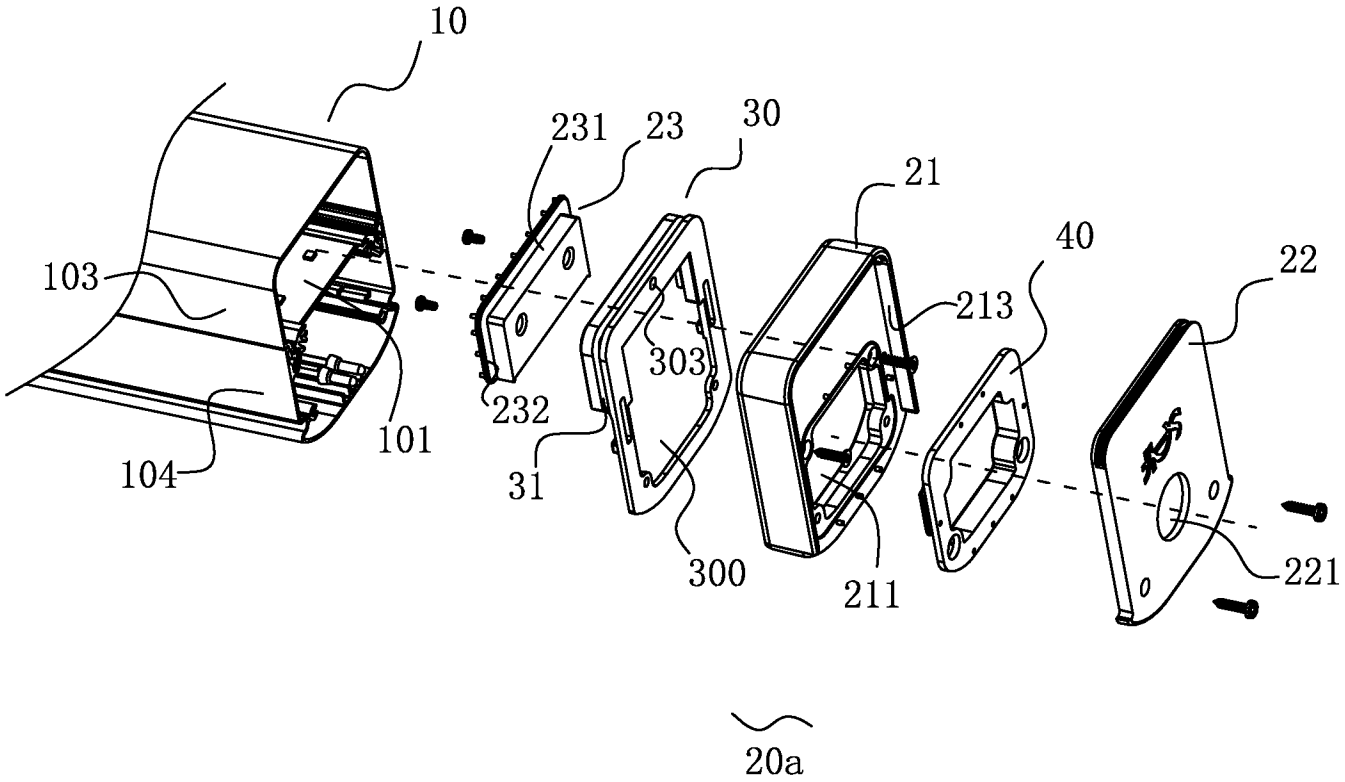
FIG. 2 is an exploded perspective view showing a wiring end cover of a waterproof lamp according to an embodiment of the present invention.
Figure 7:
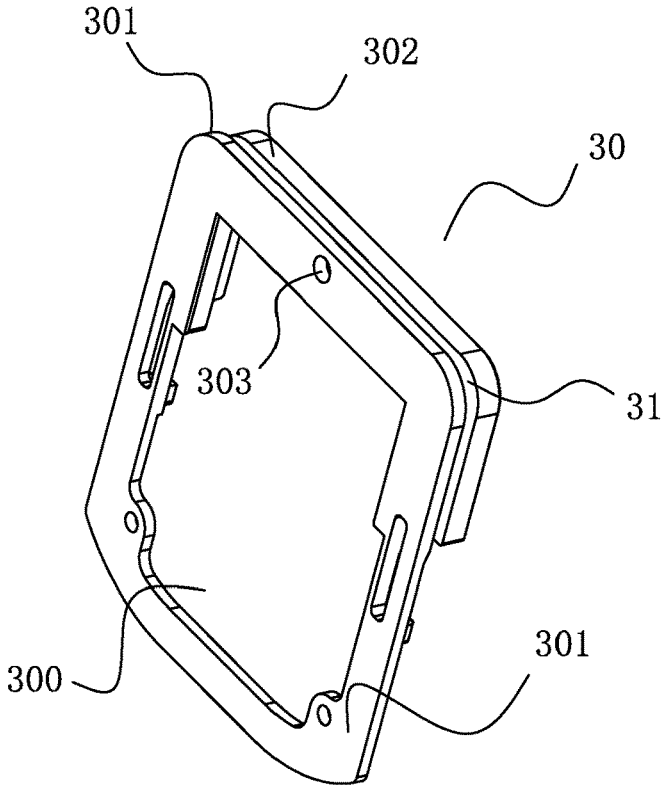
FIG. 7 is a three-dimensional structure diagram of a first sealing member of a waterproof lamp according to an embodiment of the present invention.
Figure 8:
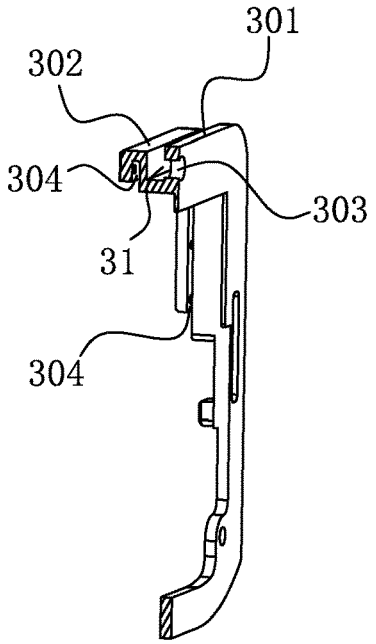
FIG. 8 is a cross-sectional structural view showing a first sealing member of a waterproof lamp according to an embodiment of the present invention.

Referring to FIG. 7 and FIG. 8, the first sealing member 30 has an annular outer sealing portion 301 and an inserting portion 302 protruding from the outer sealing portion 301 to one side, wherein the outer sealing portion 301 is clamped between the fixed end cover 21 and the end wall surface of the wiring opening 101, the inserting portion 302 can be embedded into the inner cavity of the housing 10 and in close contact with the inner wall surface of the housing 10. The sealant groove 31 is arranged on a surface in contact with the inner wall surface of the housing 10 and the inserting portion 302. The first sealing member 30 has a double sealing waterproof effect, wherein the outer sealing portion 301 is clamped between the fixed end cover 21 and the end wall surface of the wiring opening 101 to realize the first waterproof seal, and the waterproof rubber layer formed by injecting the liquid sol into the sealant groove 31 of the inserting portion 302 is fully in contact with the inner wall surface of the housing 10 to realize the second waterproof seal. It is conceivable for those skilled in the art to achieve a better sealing effect. The first sealing member 30 may be made of a metal material or a non-metallic material such as asbestos or rubber. Referring to FIG. 2, in the embodiment, the first sealing member 30 is provided with a through hole 300 for wire going through, and the corresponding fixed end cover 21 is provided with a wire crossing opening 211 for the wire outgoing through, and the movable cover 22 is provided a wire outlet opening 221 corresponding to the wire crossing opening 211, wherein the second sealing member 40 is sealed on the periphery of the wire crossing opening 211. Specifically, the size of the wire outlet opening 221 on the movable cover 22 is slightly smaller than that of the wire crossing opening 211 on the fixed end cover 21, so that the movable cover 22 can completely fit the second sealing member 40, so as to ensure a good sealing effect between the movable cover 22 and the fixed end cover 21. In order to increase the waterproof effect at the wire outlet opening 221 of the movable cover 22, when lead out the wire, the wire passes through the through hole 300 of the first sealing member 30, the wire crossing opening 211 of the fixed end cover 21 and the wire outlet opening 221 of the movable cover 22 in turn to connect the external power supply. A sealing sleeve 70 is sealing connected to the wire outlet opening 221 of the movable cover 22, and a wire drawn from the wire outlet opening 221 of the movable cover 22 is arranged in the sealing sleeve 70.

Figure 3:
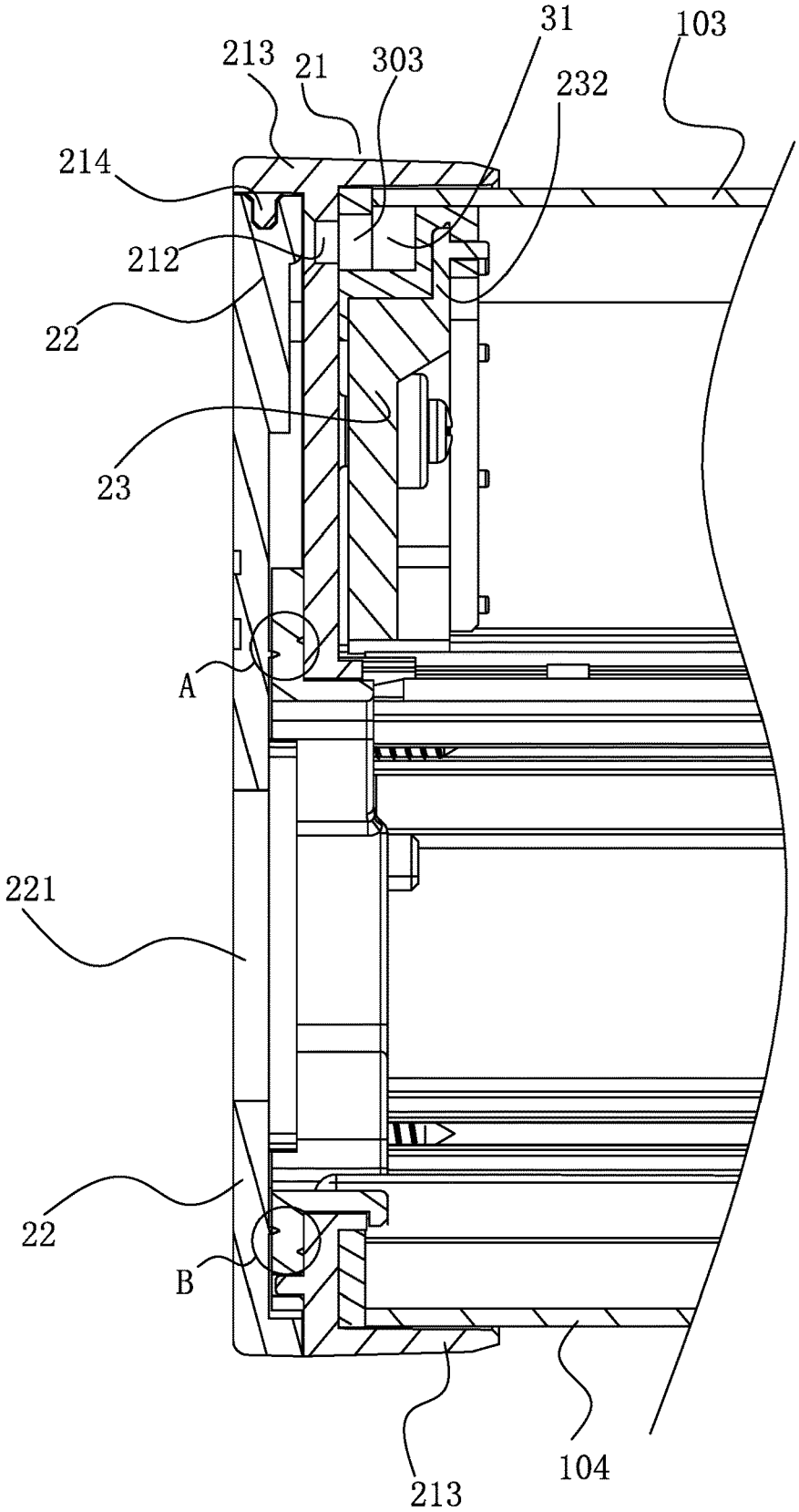
FIG. 3 is a cross-sectional view of a wiring end cover of a waterproof lamp according to an embodiment of the present invention.
Figure 9:
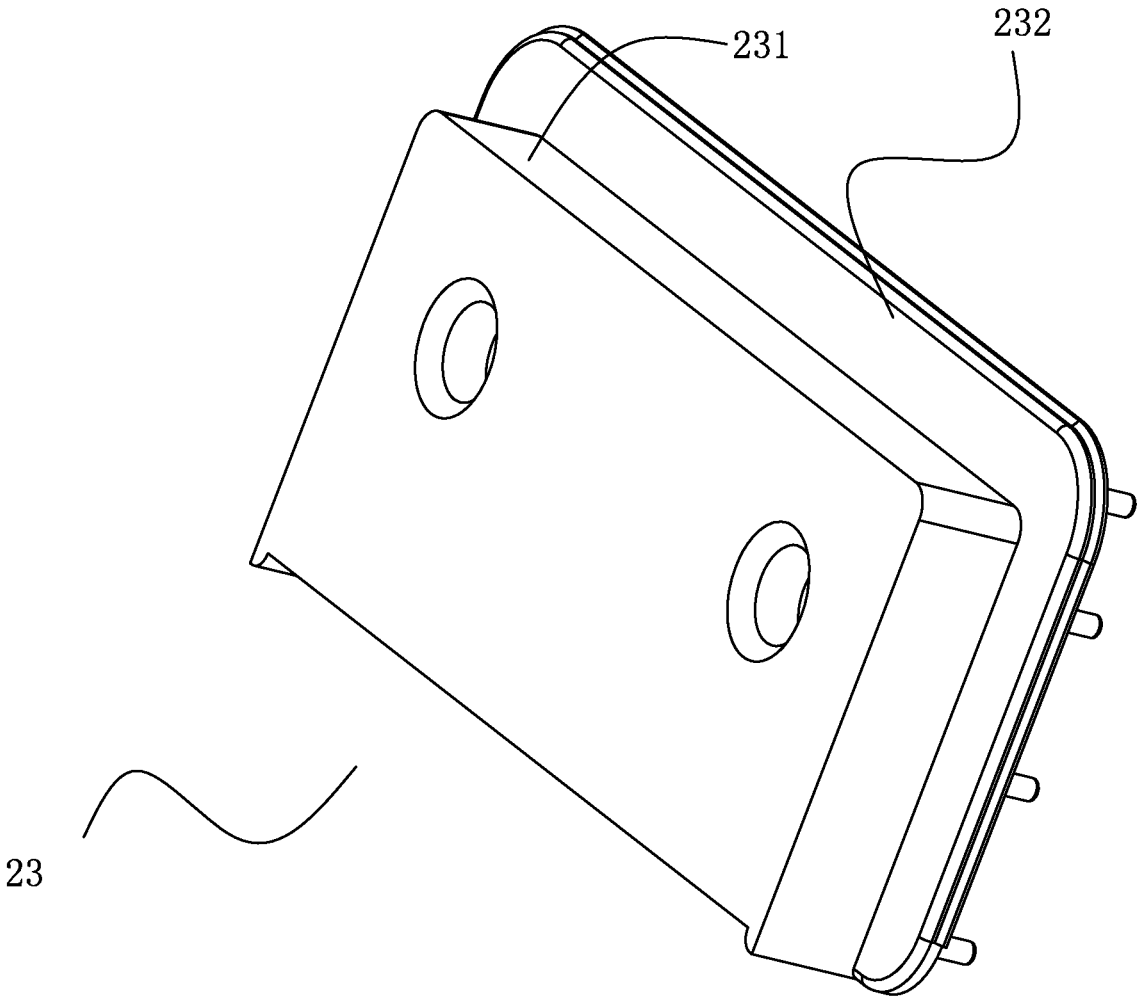
FIG. 9 is a three-dimensional structural diagram of a fixing plate of a waterproof lamp according to an embodiment of the present invention.

Referring to FIG. 2 and FIG. 3, the wiring end cover 20*a* includes a fixing plate 23 for fixedly connecting the first sealing member 30 to the fixed end cover 21. The fixing plate 23 has a supporting portion 231 for supporting the inserting portion 302 fitting to the inner wall surface of the housing 10. The first sealing member 30 can be fixed on the fixed end cover 21 by the fixing plate 23 to form an integral member. In the process of installation, the integral member can be directly stuck in the wiring opening 101, instead of installing each part in turn, which simplifies the installation procedure. The supporting portion 231 is provided to clamp the inserting portion 302 between the supporting portion 231 and the inner wall surface of the outer housing 10 to prevent the bottom portion of the inserting portion 302 from deforming or deflecting inwardly due to the lack of limiting action, resulting in poor waterproof sealing effect. Specifically, referring to FIG. 9, the supporting portion 231 has a deputy supporting portion 232, and the lower end surface of the inserting portion 302 of the first sealing member 30 is provided with a fitting groove 304 for the deputy supporting portion 232 to be stuck into. The deputy supporting portion 232 is inserted into the fitting groove 304 to further make the inserting portion 302 tightly fit the inner wall of the housing 10, thereby reducing the deformation or deflection to the inside of the embedded part 302 and improving the waterproof sealing effect.

Figure 10:
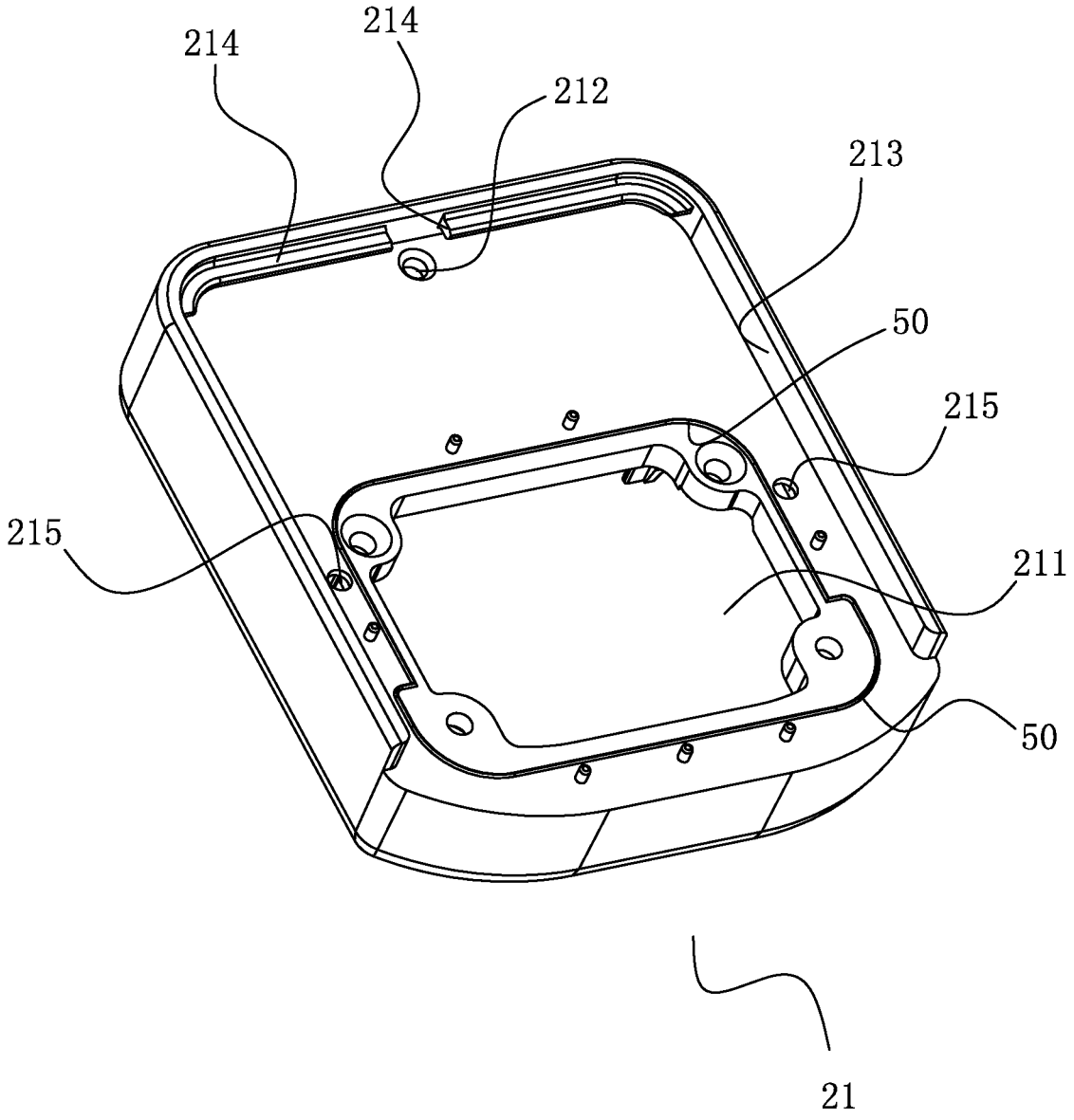
FIG. 10 is a three-dimensional structural diagram of a fixed end cover of a waterproof lamp according to an embodiment of the present invention.

Continuing to refer to FIG. 7 and FIG. 10, in order to facilitate the injection of the liquid sol into the sealant groove 31 of the first sealing member 30, in the present embodiment, the fixed end cover 21 is provided with a first injection hole 212 for injecting glue into the sealant groove 31. In the corresponding position of the first injection hole 212, the first sealing member 30 is provided with a second injection hole 303, which is from the first injection hole 212 through to the sealant groove 31. The fixed end cover 21 is further provided with an overflow hole 215 connected with the sealant groove 31. In the embodiment, two overflow hole 215 are respectively disposed on the farthest end of fixed end cover 21 away from the first injection hole 212. When the liquid sol overflows from the overflow hole 215, it indicates that the liquid sol has filled the entire sealant groove 31, and the sealing performance is ensured. After the fixed end cover 21 and the first sealing member 30 are fixed through the fixing plate 23 to form an integral part, the integral part can be embedded in the wiring opening 101 of the housing 10, and then through the first injection hole 212 on the fixed end cover 21 it can be effectively sealed by injecting liquid sol into the sealant groove 31 from the outside. Specifically, the fixed end cover 21 and the housing 10 are also fixed by screws. The connection mode between the fixed end cover 21 and the housing 10 is fixed by screws; on the one hand, the outer sealing portion 301 of the first sealing member 30 can be clamped between the fixed end cover 21 and the end wall surface of the wiring opening 101 to achieve a better sealing effect. On the other hand, the fixed end cover 21 is fixedly connected with the housing 10 to avoid that the fixed end cover 21 is swaying or offset from the housing 10 relative to housing 10 after the completion of glue injection, affecting the seal between the waterproof rubber layer formed by solidification of the liquid sol and the inner wall surface of the housing 10.

Figure 4:
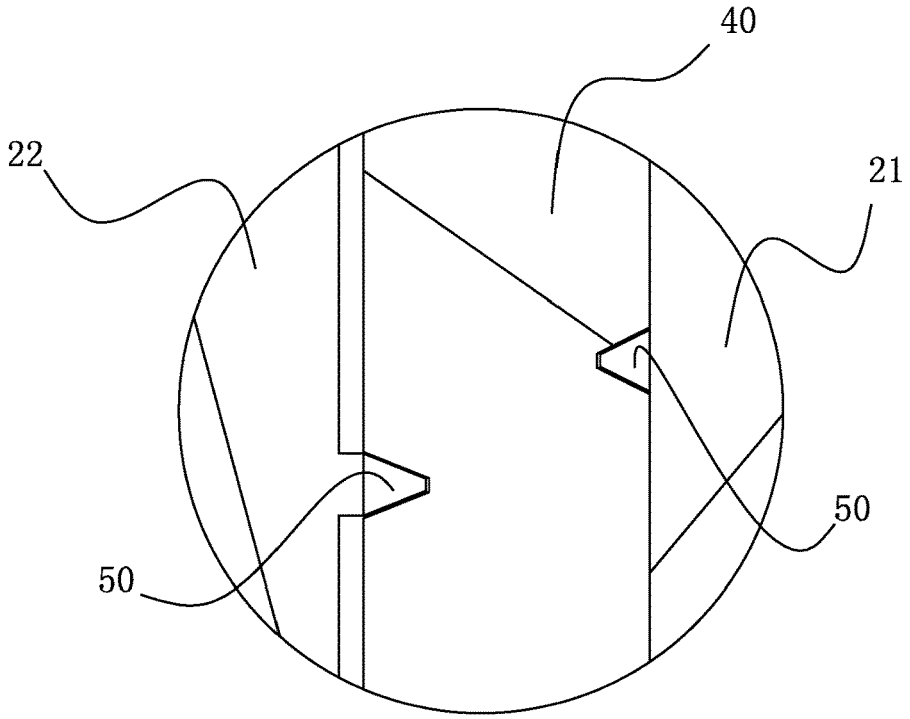
FIG. 4 is a partial enlarged view of A in FIG. 3.
Figure 5:
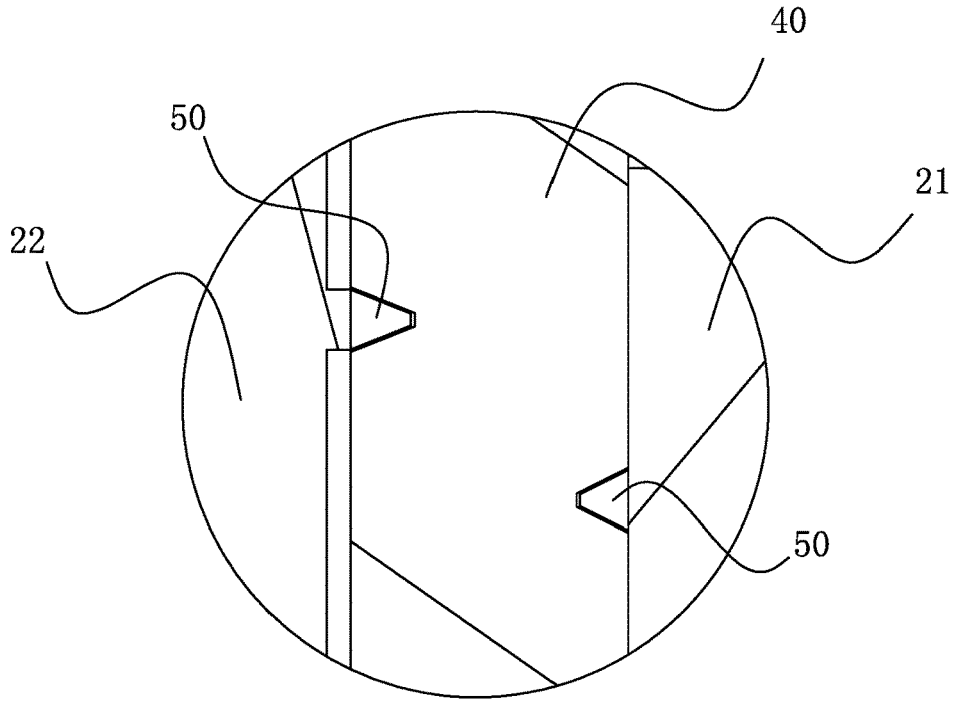
FIG. 5 is a partial enlarged view of B in FIG. 3.
Figure 11:
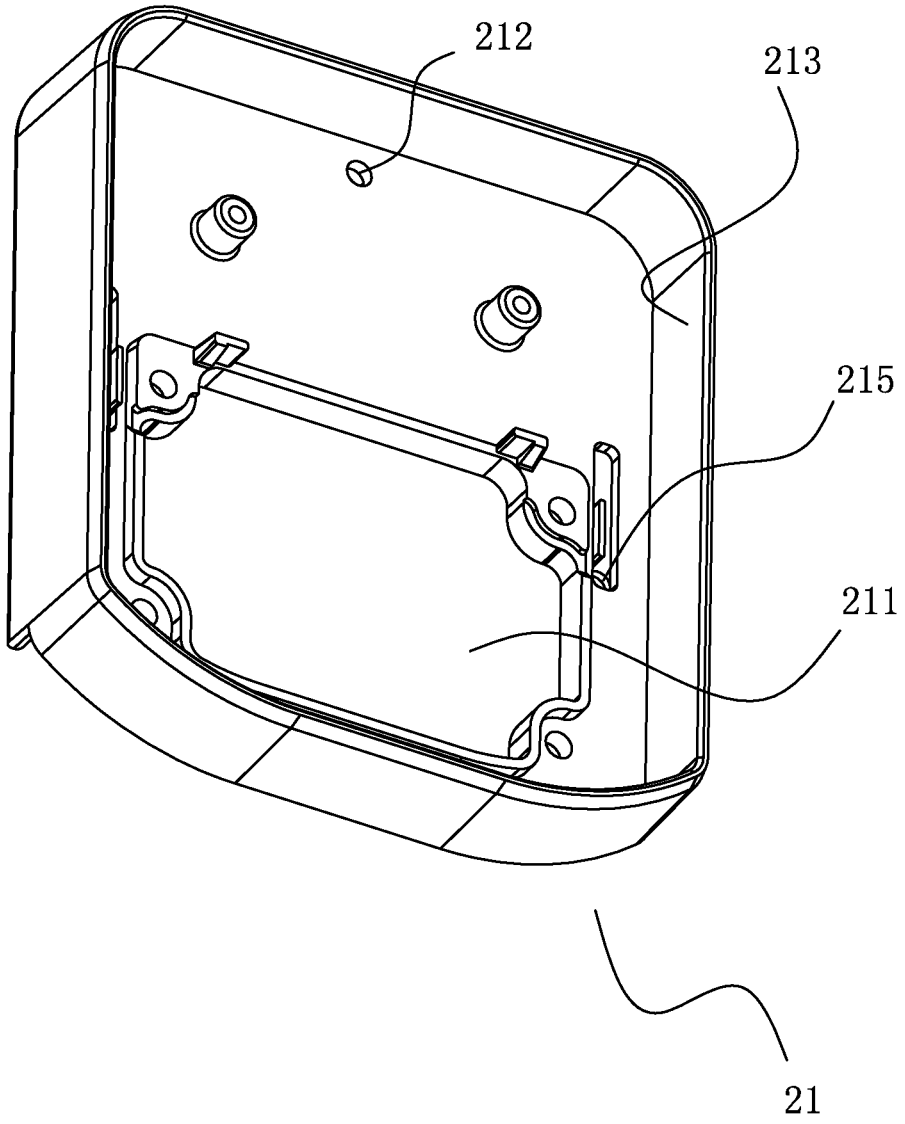
FIG. 11 is a another angle three-dimensional structure diagram of a fixed end cover of a waterproof lamp according to an embodiment of the present invention.
Figure 12:
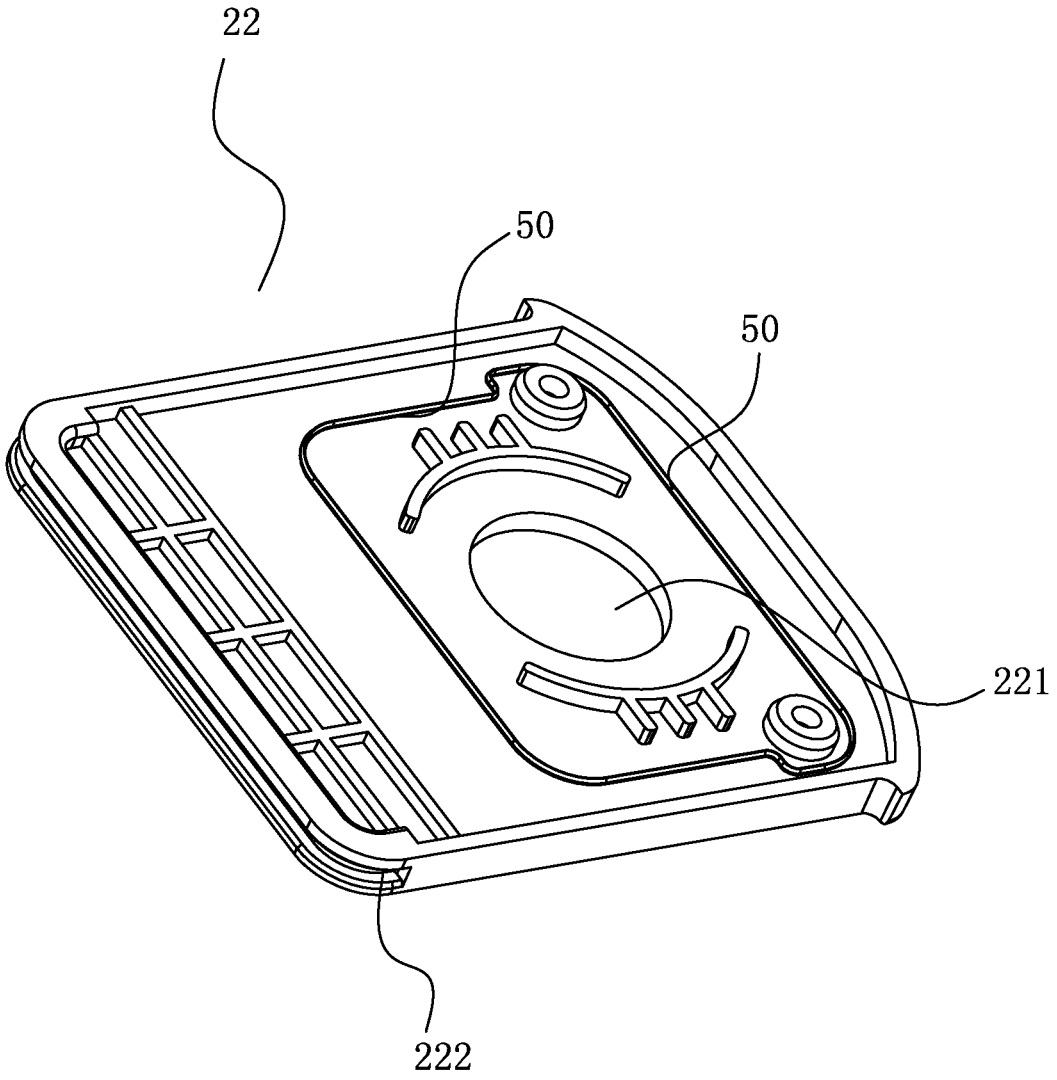
FIG. 12 is a three-dimensional structural diagram of a movable cover of a waterproof lamp according to an embodiment of the present invention.

Referring to FIG. 10, FIG. 11 and FIG. 12, the fixed end cover 21 further has an annular limiting portion 213 surrounding the outer periphery of the movable cover 22. The inner wall surface of the annular limiting portion 213 and the movable cover 22 are connected by means of rib groove. Specifically, the annular limiting portion 213 of the fixed end cover 21 has a limiting rib 214, and the movable cover 22 is provided with a limiting groove 222 adapted to the limiting rib 214, and the waterproofing effect between the fixed end cover 21 and the movable cover 22 is further improved by the connected means of rib groove between the inner wall surface of the annular limiting portion 213 of the fixed end cover 21 and the movable cover 22. In addition, in order to make the movable cover 22 tightly fit the second sealing member 40 and achieve good seal between the movable cover 22 and the fixed end cover 21, the movable cover 22 is connected to the fixed end cover 21 through screws, of course, when wiring or maintenance is required, just remove the screw and open the movable cover 22. Referring to FIG. 3, FIG. 4 and FIG. 5, in order to further improve the sealing effect of the periphery of the wire crossing opening 211 on the fixed end cover 21, the fixed end cover 21 and the movable cover 22 are provided with a ring of waterproof rib 50 on the side opposite to the second sealing member 40, and the waterproof rib 50 can be embedded in the corresponding portion of the second sealing member 40 to achieve sealing.

Figure 6:
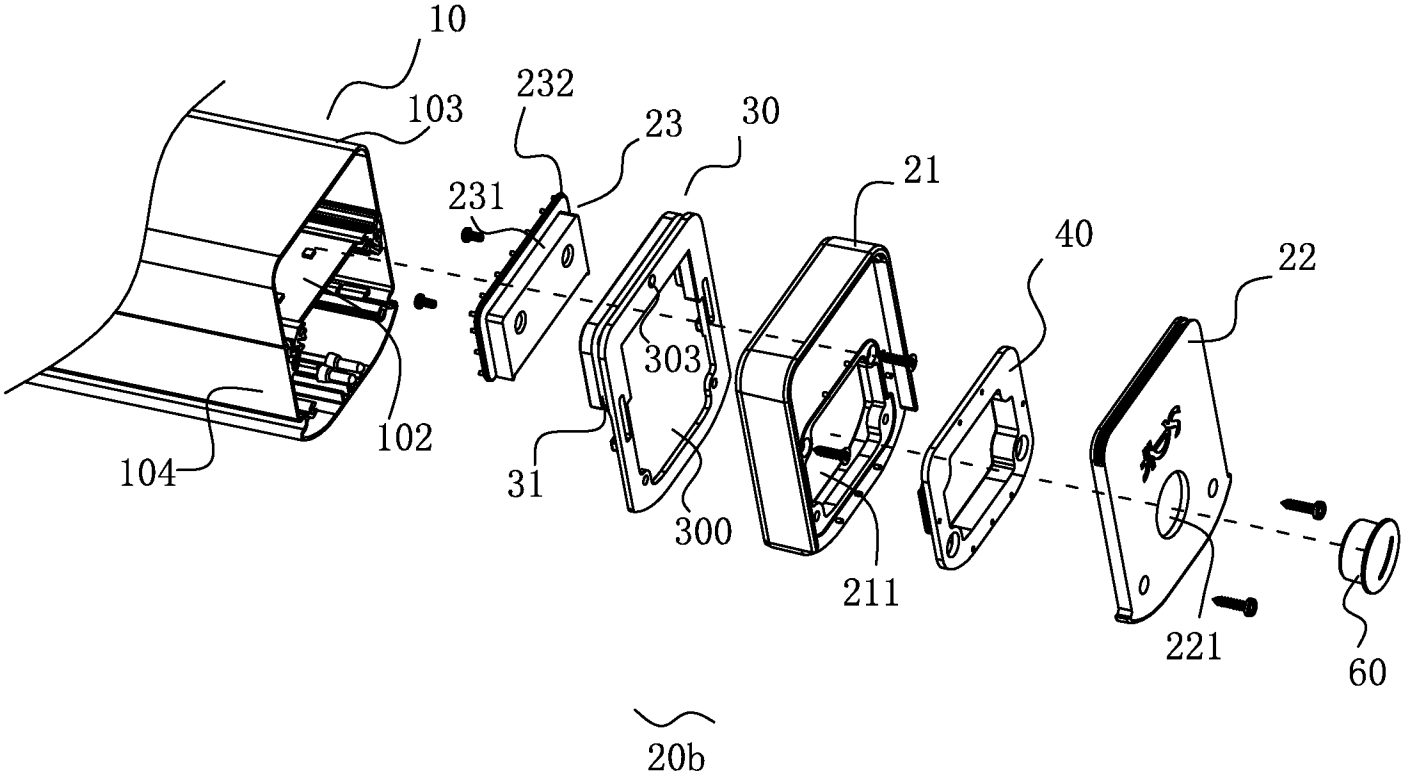
FIG. 6 is an exploded perspective view of a sealing end cover of a waterproof lamp according to an embodiment of the present invention, including a waterproof plug.

Referring to FIG. 6, in the present embodiment, the other opening of the housing 10 is a sealing opening 102, and the sealing opening 102 is covered with a sealing end cover 20*b*. In the embodiment, the structure of the sealing end cover 20*b* is the same as that of the wiring end cover 20*a* at the wiring opening 101, that is, the sealing end cover 20*b* also includes the fixed end cover 21, the first sealing member 30, the fixing plate 23, the movable cover 22 and the second sealing member 40, and the wire outlet opening 221 of the movable cover 22 of the sealing end cover 20*b* is sealed with a waterproof plug 60. Since the sealing end cover 20*b* has the same structure as the wiring end cover 20*a*, only one type of end cover structure needs to be processed, which reduces the processing cost, and these kinds of lamps can choose any opening of housing 10 to be used for leading wiring.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A waterproof lamp comprising:

a housing having an inner cavity for accommodating the main body of the lamp, and forming a wiring opening for leading out wire at least at one end of the housing;

a wiring end cover sealed on the wiring opening for allowing the wire to pass through;

a first sealing member formed between the wiring end cover and an inner wall surface of the housing and matched with the wiring end cover for the wire to pass through; the first sealing member is provided with a sealant groove for injecting liquid sol on a surface in contact with the inner wall surface of the housing; the first sealing member has an annular outer sealing portion and an inserting portion protruding from the outer sealing portion to one side; the sealant groove is arranged on a surface in contact with the inner wall surface of the housing and the inserting portion;

the wiring end cover includes a fixed end cover and a movable cover, and the movable cover is detachably connected to an outside of the fixed end cover;

a second sealing member is disposed between the movable cover and the fixed end cover;

the outer sealing portion of the first sealing member is clamped between the fixed end cover and an end wall surface of the wiring opening, and the inserting portion can be embedded into the inner cavity of the housing and in contact with the inner wall surface of the housing.

2. The waterproof lamp of claim 1, wherein the first sealing member has a through hole for wire going through; the fixed end cover is provided with a wire crossing opening for the wire outgoing through, the movable cover has a wire outlet opening corresponding to the wire crossing opening; the second sealing member is sealed on the periphery of the wire crossing opening.

3. The waterproof lamp of claim 2, wherein the fixed end cover is provided with a first injection hole for injecting glue into the sealant groove, and at a corresponding position with the first injection hole the first sealing member is provided with a second injection hole, which extends from the first injection hole through to the sealant groove.

4. The waterproof lamp of claim 3, wherein the wiring end cover comprises a fixing plate for fixedly connecting the first sealing member to the fixed end cover, and the fixing plate has a supporting portion that supports the inserting portion fitting to the inner wall surface of the housing.

5. The waterproof lamp of claim 4, wherein the supporting portion has a deputy supporting portion, and a lower end surface of the inserting portion of the first sealing member is provided with a fitting groove for the deputy supporting portion to be stuck into.

6. The waterproof lamp of claim 5, wherein the fixed end cover and the movable cover are each provided with waterproof ribs on sides adjacent to the second sealing member, and the waterproof ribs are embedded in corresponding portions of the second sealing member to achieve sealing.

7. The waterproof lamp of claim 6, wherein the fixed end cover and the housing are fixed by screws; the movable cover is connected to the fixed end cover by screws.

8. The waterproof lamp of claim 7, wherein the fixed end cover further has an annular limiting portion surrounding the outer periphery of the movable cover, and at least one rib groove connects an inner wall surface of the annular limiting portion to the movable cover.

9. The waterproof lamp of claim 8, wherein the housing has two openings, one of which is the wiring opening and the other is a sealing opening, and the sealing opening is covered with a sealing end cover, the sealing end cover is identical in structure to the wiring end cover, and the wire outlet opening of the movable cover of the sealing end cover is sealed with a waterproof plug.

* * * * *